United States Patent [19]

Potter et al.

[11] Patent Number: 4,913,168

[45] Date of Patent: Apr. 3, 1990

[54] FLAVOR DELIVERY ARTICLE

[75] Inventors: Dennis L. Potter, Kernersville; Mark L. Raker, Clemmons; Henry T. Ridings, Lewisville; Andrew J. Sensabaugh, Jr., Winston-Salem; Amos E. Westmoreland, Winston-Salem; Donna K. Woods, Winston-Salem; Chandra K. Banerjee, Pfafftown, all of N.C.

[73] Assignee: R. J. Reynolds Tobacco Company, Winston-Salem, N.C.

[21] Appl. No.: 278,060

[22] Filed: Nov. 30, 1988

[51] Int. Cl.[4] ..... A24F 1/00

[52] U.S. Cl. ..... 131/194; 131/273; 131/360

[58] Field of Search ..... 131/273, 194–197

[56] References Cited

U.S. PATENT DOCUMENTS

| | | | |
|---|---|---|---|
| 2,104,266 | 1/1938 | McCormick | 131/12 |
| 3,258,015 | 6/1966 | Ellis et al. | 131/171 |
| 3,683,936 | 8/1972 | O'Neil, Jr. | 131/8 |
| 3,766,079 | 10/1973 | Jackman | 252/188.3 R |
| 3,875,083 | 4/1975 | Murtaugh | 252/535 |
| 3,924,603 | 12/1975 | Chapin | 126/263 |
| 3,968,048 | 7/1976 | Bolan | 252/157 |
| 4,058,474 | 11/1977 | Keyes et al. | 252/160 |
| 4,067,313 | 1/1978 | Donnelly | 126/263 |
| 4,079,742 | 3/1978 | Rainer et al. | 131/2 |
| 4,149,548 | 4/1979 | Bradshaw | 131/273 |
| 4,206,068 | 6/1980 | Davis | 252/89.1 |
| 4,284,089 | 8/1981 | Ray | 131/270 |
| 4,338,098 | 7/1982 | Yamaji | 44/3 A |
| 4,393,884 | 7/1983 | Jacobs | 131/273 |
| 4,574,051 | 3/1986 | Matthews et al. | 252/70 |
| 4,774,971 | 10/1988 | Vieten | 131/273 |

FOREIGN PATENT DOCUMENTS

| | | |
|---|---|---|
| 276250 | 6/1967 | Australia . |
| 8602528 | 5/1986 | PCT Int'l Appl. . |

*Primary Examiner*—V. Millin
*Assistant Examiner*—Jennifer L. Doyle

[57] ABSTRACT

A flavor delivery article provides volatilized flavor by heating a flavor carrying substrate, but not burning any material. A heat source which includes a metal oxide (e.g., calcium oxide), an anhydrous metal sulfate (e.g., magnesium sulfate), an inorganic salt and a sugar, generates heat upon contact of water therewith. The heat produced by the heat source heats flavor in a heat exchange relationship therewith. Flavors volatilize and are drawn into the mouth of the user of the article. Typical heat sources heat the flavor to a temperature within 70° C. to 200° C. for 4 to 8 minutes.

69 Claims, 1 Drawing Sheet

FLAVOR DELIVERY ARTICLE

BACKGROUND OF THE INVENTION

The present invention relates to flavor delivery articles which employ a relatively low temperature heat source to volatilize a flavor for delivery.

Over the years, there have been proposed numerous smoking products, flavor generators and medicinal inhalers which utilize various forms of energy to vaporize or heat a volatile material for delivery to the mouth of the user.

U.S. Pat. No. 3,258,015 and Ellis et al Australian Patent No. 276,250 proposed, among other embodiments, a smoking article having cut or shredded tobacco mixed with a pyrophorous material such as finely divided aluminum hydride, boron hydride, calcium oxide or fully activated molecular sieves. In use, one end of the article was dipped in water, causing the pyrophorous material to generate heat which reportedly heated the tobacco to a temperature between 200° C. and 400° C. to cause the tobacco to release volatilizable materials. Ellis et al also proposed a smoking article including cut or shredded tobacco separated from a sealed pyrophorous material such as finely divided metallic particles. In use, the metallic particles were exposed to air to generate heat which reportedly heated the tobacco to a temperature between 200° C. and 400° C. to release aerosol forming materials from the tobacco.

Nilsson et al PCT Publication No. WO 86/02528 proposed an article similar to that described by McCormick. Nilsson et al proposed an article for releasing volatiles from a tobacco material which had been treated with an aqueous solution of sodium carbonate. The article resembled a cigarette holder and reportedly included a battery operated heating coil to heat an untipped cigarette inserted therein. Air drawn through the device reportedly was subjected to elevated temperatures below the combustion temperature of tobacco and reportedly liberated tobacco flavors from the treated tobacco contained therein. Nilsson et al also proposed an alternate source of heat whereby two liquids were mixed to produce heat.

Despite many years of interest and effort, none of the foregoing non-combustion articles has ever realized any significant commercial success, and it is believed that none has ever been widely marketed. Moreover, it is believed that none of the foregoing noncombustion articles is capable of providing acceptable flavor delivery to the user.

Thus, it would be desirable to provide a flavor delivery article which utilizes non-combustion energy and which is capable of providing acceptable quantities of pleasant tasting flavored vapor over at least 6 to 10 puffs.

SUMMARY OF THE INVENTION

The present invention relates to flavor delivery articles which normally employ a non-combustion heat source for heating flavor for delivery to the user thereof. Articles of the present invention produce controlled amounts of volatilized flavors and other substances which do not volatilize to any significant degree under ambient conditions, and such volatilized substances can be provided throughout each puff, for at least a 6 to 10 puff product life.

More particularly, the present invention relates to flavor delivery articles having a low temperature heat source which generates heat as a result of one or more exothermic interactions between the components thereof. The flavor, which can be carried by a substrate, is positioned physically separate from, and in a heat exchange relationship with, the heat source. By "physically separate" is meant that the flavor used for flavor delivery is not mixed with, or is not a part of, the heat source.

The heat source includes at least one chemical agent which is capable of interacting exothermically with a second chemical agent upon contact and/or suitable activation. Preferably, the heat source includes more than one agent which interacts with the second agent. Preferably, the chemical agents do not require environmental (i.e., atmospheric) oxygen to generate heat. The chemical agents can be incorporated or introduced into the heat source in a variety of ways. For example, the agents can be mixed together, and the exothermic interaction therebetween can be initiated upon the introduction of a catalyst or initiator thereto. Alternatively, the various agents can be incorporated into the heat source physically separate from one another, and exothermic interaction therebetween is provided by initiating contact of the various agents. In yet another regard, agents within the heat source can have a second agent introduced into the heat source to provide the generation of heat.

The heat source also normally includes (i) a dispersing agent to reduce the concentration of the aforementioned chemical gents and help control (i.e., limit) the rate of interaction of the chemical agents, and/or (ii) a phase change material which normally undergoes a reversible phase change during heat generation from a solid state to a liquid state, and back again, to initially absorb heat generated by the chemical interactants and to release that heat during the later stages of heat generation. The dispersing agent and/or the phase change material help (i) reduce the maximum temperature of the heat source and the flavor; and (ii) prolong the life of the heat source by limiting the rate of interaction of the chemical agents, in the case of the dispersing agent, and by absorbing and releasing heat, in the case of the phase change material.

A preferred heat source is a mixture of solid components which provide the desired heat delivery upon interaction of certain components thereof with a liquid such as water. For example, a solid mixture of calcium oxide, anhydrous magnesium sulfate, malic acid, dextrose and sodium chloride can be contacted with liquid water to generate heat. Heat is generated by the hydration of the magnesium sulfate, as well as by the malic acid catalyzed reaction of water and calcium oxide to yield calcium hydroxide. The dextrose undergoes a phase change from solid to liquid as the exothermic chemical interactions occur, thus absorbing energy. This absorbed energy is released at a later time when the heat generated by the chemical interactions diminish and the dextrose re-solidifies. The sodium chloride is employed as a dispersing agent in an amount sufficient to disperse the various components of the heat source to provide a controlled interaction of components over time.

Another preferred heat source is a mixture of finely divided aluminum metal and granular sodium nitrite which can be contacted with an aqueous solution of sodium hydroxide to generate heat. Heat is generated by reaction of the aluminum metal with the sodium hydroxide and water to yield sodium aluminate and hydrogen. The sodium nitrite reacts with the hydrogen to regenerate water and sodium hydroxide. As such, reactants for the heat generating reaction with the aluminum metal are regenerated such that a controlled generation of heat is provided over time.

Preferred heat sources generate relatively large amounts of heat to rapidly heat at least a portion of the flavor to a temperature sufficient to volatilize the flavor. For example, preferred articles employ a heat source capable of heating at least a portion of the flavor to above about 70° C. within 20 seconds from the time that the heat source is activated. Preferred articles employ heat sources which avoid excessive heating of the flavor and maintain the flavor within a desired temperature range for about 4 to about 8 minutes. For example, it is desirable that the flavor of the article not exceed 350° C., and more preferably not exceed 200° C. during the useful life of the article. For the highly preferred flavor delivery articles, the heat sources thereof heat the flavor contained therein to a temperature range between about 70° C. and about 180° C., during the useful life of the article.

Flavors normally are carried by a substrate having a porous or fibrous character, or high surface area. Normally, the substrate is such that the flavor is carried readily by the substrate prior to use of the article, but such that the flavor is released readily at those temperatures provided by the heat source.

To use the flavor delivery article of the invention, the user initiates the interaction between the components of the heat source, and heat is generated. The interaction of the components of the heat source provides sufficient heat to heat the flavor and the flavor is volatilized from the substrate. When the user draws on the article, the volatilized substances pass through the article and into the mouth of the user.

The articles of the present invention are described in greater detail in the accompanying drawings and in the detailed description of the invention which follows.

DETAILED DESCRIPTION OF THE PREFERRED EMBODIMENTS

Figure 1:
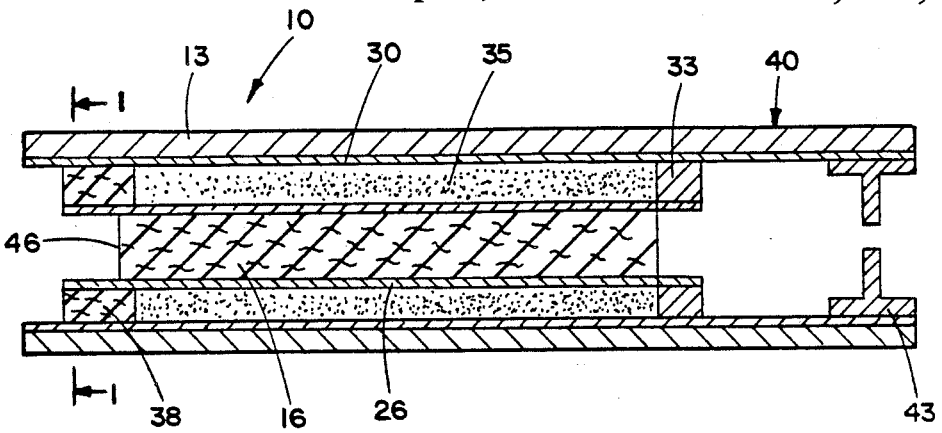
FIGS. 1 and 2 are longitudinal, sectional views of representative embodiments of this invention.
Figure 1A:
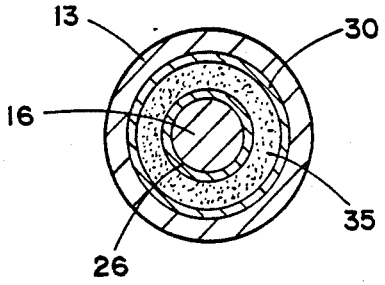
FIG. 1A is a cross sectional view of the embodiment shown in FIG. 1 taken along lines 1—1 in FIG. 1.

Referring to FIG. 1, flavor delivery article 10 has an elongated, essentially cylindrical rod shape. Normally, the length of the article ranges from about 70 mm to about 120 mm, and the circumference ranges from about 22 mm to about 30 mm.

The article includes an outer member 13 which is a wrapper as well as a means for providing insulative properties. As shown in FIG. 1, the outer member 13 can be a layer of thermally insulative material, such as foamed polystyrene sheet, foil lined paperboard, or the like. The outer member also can be a paper wrapper, or an insulative outer member can be wrapped further with a paper wrapper (not shown).

Within the outer member 13 is positioned a flavor carrying substrate 16 which extends along a portion of the longitudinal axis of the article. The substrate can have a variety of configurations, and preferably has a high surface area to maximize contact with draw air passing therethrough. As illustrated, the substrate 16 can be in the form of an air permeable fabric which can have a plurality of air passageways extending longitudinally therethrough or therearound.

The substrate 16 is located within tubular container 26 which can be formed from a heat resistant thermoplastic, metal, or the like. A second tubular container 30 surrounds the first tubular container 26, and optionally the length of the article. The second tubular container can be formed from a heat resistant thermoplastic material, foil lined paperboard, or the like. A barrier 33 is positioned in the annular region between tubular containers 26 and 30 near the mouthend of tubular container 26, and provides an effective air seal between the two containers in that region. The barrier can be manufactured from thermoplastic material, or the like, and can be maintained in place between the tubular containers 26 and 30 by a tight friction fit, adhesive, or other such means.

A heat source 35 (discussed in greater detail hereinafter) is positioned in the annular region between tubular containers 26 and 30. An air permeable plug 38 is positioned opposite the mouthend of the article between tubular containers 26 and 30, and acts to maintain the heat source 16 in the desired position and location about the substrate 16. Plug 38 can be a fibrous material such as plasticized cellulose acetate, or a resilient open cell foam material. The article 10 includes a mouthend region 40 which can include a filter element 43 or other suitable mouthend piece which provides a means for delivering flavor to the mouth of the user. The filter 43 can have a variety of configurations and can be manufactured from cellulose acetate tow, a pleated polypropylene web, molded polypropylene, or the like. Normally, the filter 43 is provided for aesthetic purposes, and preferably has a low filtration efficiency. For example, the filter can have a molded form such as a baffled configuration (as shown in FIG. 1). In particular, it is most desirable that high amounts of the volatilized flavor components pass to the mouth of the user, and that low amounts of the flavor components be deposited onto the filter. The article also includes an air inlet region 46, opposite the mouthend region 40, in order that drawn air can enter the article.

Figure 2:
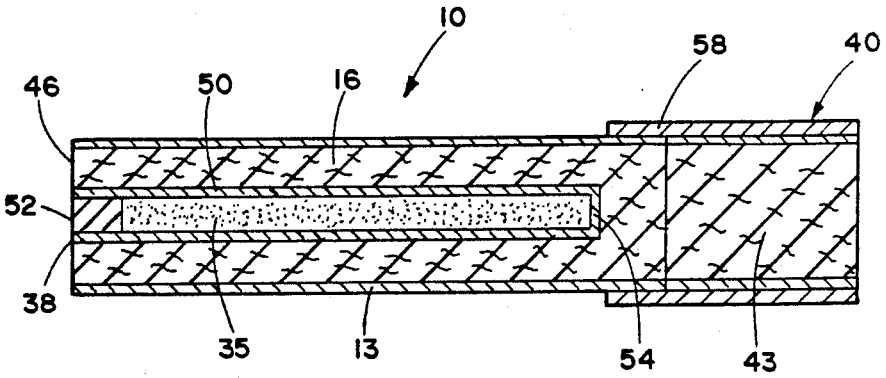

Referring to FIG. 2, flavor delivery article 10 includes a generally tubular outer member 13, such as a paper wrapper, which contains a flavor carrying substrate. Within the substrate is positioned a heat resistant cartridge 50 having an open end 52 near the air inlet region 46 of the article, and a sealed end 54 toward the mouth end of the substrate. The cartridge 50 preferably is composed of a heat conductive material, such as aluminum or other metallic material.

Within the cartridge is positioned heat source 35 (discussed in detail hereinafter). The heat source material 35 is maintained in place within the cartridge 50 by an air permeable plug 38 such as cellulose acetate. The resulting rod, having the heat source embedded therein, but such that the flavor components and heat source components are physically separate from one another, generally has a length of about 50 mm to about 90 mm, and a circumference of about 22 mm to about 30 mm.

Filter element 43 is axially aligned with, and positioned in an end-to-end relationship with the rod. The filter element and rod are secured together using tipping paper 58. Normally, tipping paper has adhesive applied to the inner face thereof circumscribes the filter element and an adjacent region of the rod.

In use, the user initiates exothermic interaction of the heat source so that the heat source generates heat. For example, an effective amount of liquid water can be injected into the heat source so that the water can interact exothermically with certain components of the heat source. The resulting heat acts to warm the physically separate flavor components which are positioned in close proximity to the heat source so as to be in a heat exchange relationship therewith. The heat so supplied to the flavor source acts to volatilize flavorful components of the flavor source. The volatilized materials then are drawn to the mouth end region of the article and into the user's mouth. The heat source of this invention provides sufficient heat to volatilize flavorful components while maintaining the temperature of the flavor and substrate within the desired temperature range. When heat generation is complete, the substrate carrying the flavor components begins to cool and volatilization of flavorful components thereof decreases. The article then is discarded or otherwise disposed of.

Heat sources of the articles of the present invention generate heat as a result of one or more exothermic chemical interactions between components thereof, and not as a result of combustion of the components thereof. As used herein, the term "combustion" relates to the oxidation of a substance to yield heat and oxides of carbon. In addition, preferred noncombustion heat sources of this invention generate heat as a result of one or more interactions between components thereof without the necessity of the presence of any gaseous or environmental oxygen (i.e., in the absence of environmental oxygen).

Preferred heat sources generate heat rapidly upon activation of the components thereof. As such, heat is generated to warm the flavor and substrate to a degree sufficient to volatilize an appropriate amount of flavorful components rapidly after the user has initiated use of the article. Rapid heat generation also assures that sufficient volatilized flavor is provided during the early puffs. Typically, heat sources of the present invention include sufficient amounts of components which undergo exothermic interactions to heat at least a portion of the flavor components to a temperature in excess of 70° C., more preferably in excess of 80° C., within about 20 seconds, more preferably within about 10 seconds, from the time that the user has initiated use of the article.

Preferred heat sources generate heat so that the flavor is heated to within a desired temperature range during the useful life of the article. For example, although it is desirable for the heat source to heat at least a portion of the flavor to a temperature in excess of 70° C. very rapidly when use of the article is initiated, it is also desirable that the flavor experience a temperature of less than about 350° C., preferably less than about 200° C., during the 4 to 8 minute life of the article. Thus, once the heat source achieves sufficient rapid heat generation to heat the flavor to the desired minimum temperature, the heat source then generates heat sufficient to maintain the flavor within a relatively narrow and well controlled temperature range for the remainder of the heat generation period. Typical temperature ranges for the 4 to 8 minute life of the article are between about 70° C. and about 180° C., more preferably between about 80° C. and about 140° C., for most articles of the present invention. Control of the maximum temperature exhibited by the heat source is desired in order to avoid thermal degradation and/or excessive, premature volatilization of the flavorful components.

The heat source includes components which interact exothermically with one another when contacted with one another or when suitably activated. Such components can be in physical contact (i.e., mixed together), and the exothermic interaction thereof can be activated by heat, contact with a catalyst or initiator, or the like. Alternatively, the components can be maintained physically separate from one another, and the exothermic interaction can be initiated by contact of the components, often in the presence of a suitable catalyst or initiator.

Highly preferred interactant materials are materials capable of reacting exothermically with water. Examples of such reactants are the metal oxides which react with water to generate heat and yield metal hydroxides. Suitable metal oxides include calcium oxide, magnesium oxide, sodium oxide, and the like, as well as mixtures thereof. Other suitable interactant components include calcium hydride, calcium nitride, magnesium nitride, phosphorous pentaoxide, and the like. Such other reactants, although less preferred than the metal oxides, often can be employed in small amounts with the metal oxides in order to provide for a rapid initial production of heat.

Another highly preferred chemical interactant is one which is readily hydrated by water in an exothermic manner. Examples of such interactants are the anhydrous metal sulfates such as magnesium sulfate, aluminum sulfate, ferric chloride, magnesium chloride, and the like, as well as mixtures thereof. Other such interactants will be apparent to the skilled artisan.

Water can interact with preferred heat source components to generate heat. Other liquids such as the lower alcohols (e.g., ethanol) and the polyhydric alcohols (e.g., glycerin) as well as mixtures thereof with water can be used in certain circumstances. Contact of water with the other interactive components of the heat source can be achieved in a variety of ways. For example, the water can be injected into the heat source when activation of the heat source is desired. Alternatively, liquid water can be contained in a container separate, such as a rupturable capsule or microcapsule, from the other components of the heat source, and the container can be ruptured when contact of the water with the other heat source components is desired. Alternatively, water can be supplied to the remaining portion of the heat source in a controlled manner using a porous wick. In yet another example, water needed for the exothermic reaction thereof with interactive components can be supplied by a normally solid, fully hydrated salt (eg., aluminum potassium sulfate dodecahydrate crystals) which is mixed with the metal oxide. The water can be released by the application of heat to the heat source (eg., using a flame) which initiates the disassociation of the water from the hydrated salt.

Catalysts or initiators, other than or in addition to water, can be employed to catalyze or initiate the chemical reaction of the components which react exothermically. For example, organic acids such as malic acid, palmatic acid, boric acid, or the like, can be mixed with water and/or calcium oxide in an amount sufficient to catalyze the exothermic reaction thereof to produce calcium hydroxide. When the catalyst or initiator is mixed with the solid components of the heat source, it is preferred that the catalyst or initiator be in a solid form.

The heat source also includes a dispersing agent to provide a physical spacing of the interactant components, particularly when at least one of the interactant materials has a solid form. Preferred dispersing agents are essentially inert with respect to the components which interact exothermically. Preferably, the dispersing agent is employed in a normally solid, granular form in order to (i) maintain the reactant components in a spaced apart relationship, and (ii) allow gases such as water vapor to flow through and escape from the heat source during the heat generation period. Examples of dispersing agents are inorganic salts such as sodium chloride, potassium chloride and anhydrous sodium sulfate; inorganic materials such as finely ground alumina and silica; carbonaceous materials such as finely ground graphite, activated carbons, and powdered charcoal; and the like. Generally, the normally solid dispersing agent ranges from a fine powder to a coarse grain in size; and the particle size of the dispersing agent can affect the rate of interaction of the heat generating components, and therefore the temperature and longevity of the interaction. When water is employed as one of the chemical interactants and the dispersing agent is a water soluble inorganic salt such as sodium chloride, it is desirable that the amount of water and water soluble dispersing agent be such that a majority of the salt maintains its crystalline form.

The heat source preferably includes a phase change or heat exchanging material. Examples of such materials are sugars such as dextrose, sucrose, and the like, which change from a solid to a liquid and back again within the temperature range achieved by the heat source during use. Other phase change agents include selected waxes or mixtures of waxes, and inorganic materials such as magnesium chloride. Such materials absorb heat as the interactant components interact exothermically so that the maximum temperature exhibited by the heat source is controlled. In particular, the sugars undergo a phase change from solid to liquid upon application of heat thereto, and heat is absorbed. However, after the exothermic chemical interaction of the interactive components is nearly complete and the generation of heat thereby decreases, the heat absorbed by the phase change material can be released (i.e., the phase change material changes from a liquid to a solid) thereby extending the useful life of the article. Phase change materials such as waxes, which have a viscous liquid form when heated, can act as dispersing agents also.

The relative amounts of the various components of the heat source can vary, and often is dependent upon factors such as the minimum and maximum amounts of heat desired, the time period over which heat generation is desired, and the like. For example, when water is contacted with a mixture of a metal oxide and an anhydrous metal sulfate, it is desirable that the amount of water be sufficient to fully hydrate the anhydrous metal sulfate and react stoichiometrically with the metal oxide. Additionally, it is desirable that the amount of metal oxide and metal sulfate be sufficient to generate enough heat upon interaction with water to sufficiently heat the substrate to effect volatilization of flavorful components during the life of the article. Normally, the solid portion of such a heat source weighs less than 2 grams, and generally weighs from about 0.5 g to about 1.5 g.

Another preferred heat source can be provided by mixing granular aluminum and/or magnesium metal with granular sodium nitrite and/or sodium nitrate; and the resulting mixture can be contacted with an aqueous solution of sodium hydroxide to generate heat. Typically, the solid portion of the heat source weighs from about 50 mg to about 300 mg. The solid portion of the heat source normally is contacted with about 0.05 ml to about 0.5 ml of an aqueous solution of sodium hydroxide having a concentration of sodium hydroxide of about 5 to about 50 weight percent.

Normally, larger aluminum or magnesium particles provide for a chemical reaction which generates a lower initial amount of heat but which maintains a moderately high level of heat generation for a relatively long period of time. Additionally, the use of relatively concentrated aqueous sodium hydroxide solution provides for a reaction which generates a relatively high initial temperature. However, the addition of a buffer, such as potassium, to the reaction mixture delays initial temperature generation even though contact of the interactive components has been made (e.g., even though the sodium hydroxide solution has been added to an aluminum and sodium nitrate mixture). Alternatively, the addition of a base such as granular barium hydroxide or calcium hydroxide to the solid portion of the heat source provides for a reaction mixture which does not readily generate heat when stored, but which generates a very high amount of initial heat when contacted with an aqueous sodium hydroxide solution of another suitable initiator such as heat.

The flavor substances used in this invention are those which are capable of being vaporized by the heat sources of this invention and transported to the user in vaporous form. Pleasant tasting flavors are particularly preferred. Such flavors include menthol, spearmint, peppermint, cinnamon, vanilla, chocolate, licorice, ginger, coffee, spice, strawberry, cherry, citrus, raspberry, and the like. Breath freshener flavors are particularly preferred. Concentrated flavor extracts and artificial flavors can be employed.

The flavor substances normally are carried by a suitable substrate. For example, an amount of flavor sufficient to provide the desired flavor delivery per puff at those temperatures provided by the heat sources of the present invention is applied to the substrate. Examples of suitable substrates include fibrous materials such as cotton, cellulose acetate, carbon fibers, carbon filament yarns available as Catalogue No. CFY-0204-Z from American Kynol, Inc., and the like. Also suitable are substrates such as charcoal, pitted glass beads, alumina, and the like. Microporous materials and microspheres also can be employed. The form of the article of this invention can be altered in order to suitably contain various substrates having various forms.

The following examples are provided in order to further illustrate various embodiments of the invention but should not be construed as limiting the scope thereof. Unless otherwise noted, all parts and percentages are by weight.

EXAMPLE 1

A flavor delivery article substantially as shown in FIG. 1 is prepared as follows:

A. Heat Source Preparation

The heat source is provided by intimately mixing 36.8 parts granular calcium oxide, 10.3 parts granular anhydrous magnesium sulfate, 5.9 parts malic acid, 22 parts powdered dextrose and 25 parts granular sodium chloride.

B. Flavor Source Preparation

Menthol is applied to a length of carbon fiber yarn available as Catalogue No. CFY-0204-Z from American Kynol, Inc. As such, a flavor substrate is provided.

C. Assembly of the Article

Into a polypropylene tube of 65 mm length and 4.35 mm outer diameter is positioned the flavor substrate. The inner diameter of the polypropylene tube was such that the substrate is held in place by friction fit within the polypropylene tube by friction fit.

One end of the polypropylene tube is fitted with a short tube manufactured from Delrin which is available from E. I. duPont de Nemours. The short tube has a length of 3 mm, an outer diameter of 7.7 mm, and an inner diameter very slightly greater than that of the polypropylene tube such that short tube friction fit snuggly over the polypropylene tube (i.e., an essentially air tight seal is provided).

A second polypropylene tube of 85 mm length and 8 mm outer diameter is positioned over the Delrin tube with one end flush with the end of the 65 mm polypropylene tube remote from the Delrin tube. The other end of the second polypropylene tube extends 20 mm beyond the first polypropylene tube and the Delrin tube. The inner diameter of the second polypropylene tube is such that it friction fits snuggly over the short Delrin tube (i.e., to provide an essentially air tight seal).

Into the annular region between the two polypropylene tubes and is charged 1.5 g of the previously described heat source components such that the heat source extends about 40 mm along the length of the article.

A 7 mm length of a cellulose acetate tube is positioned so as to fit between the first and second polypropylene tubes. The cellulose acetate tube is an air permeable material commercially available as SCS-1 from American Filtrona Corp.

A mouthend piece is a resilient, molded polypropylene baffled mouthpiece element having a diameter of 7.75 mm and a length of 5 mm. The mouthpiece element is friction fit at one extreme end of the article and within polypropylene tube, and is thereby held in place.

The length of the article is circumscribed by a polystyrene foamed sheet having a thickness of about 0.8 mm, available as Roll Stock from Valcour, Inc.

The article has had an overall length of about 85 mm, an overall diameter of about 9.42 mm.

D. Use of the Article

Into the air inlet end of the article, through the cellulose acetate tube and into the solid portion of the heat source, is inserted a small diameter tube. About 0.4 ml of the water is injected through the tube into the heat source about 2 mm from the short Delrin tube.

The heat source begins to generate heat when the water is injected into the solid material. No combustion is observed. Within 7 seconds, the heat source reaches 70° C. The article maintains an average temperature of 103° C., and remains within a temperature range of 85° C. to 120° for more than 5 minutes.

The article yields flavor on all puffs for 10 puffs when drawn upon and while the heat source is generating heat even though no visible aerosol is observed.

EXAMPLE 2

The following heat source is prepared:

A wax sold commercially as Paraflint by Parafilm Corp. is ground to a particle size of about 40 to about 60 mesh. About 10 g of the Paraflint wax particles then are mixed with 20 g of calcium oxide and 40 g anhydrous magnesium sulfate. The resulting solid mixture is pressed under 15,000 pounds pressure using a Carver Laboratory Press to a cylindrical pill having a diameter of 1 inch and a thickness of 14 cm. The pill then is ground into a coarse powder. About 1 g of the coarse powder is contacted with about 0.5 ml of water to generate heat.

EXAMPLE 3

The following heat source is prepared:

About 100 mg of aluminum metal powder having a size of −325 U.S. mesh is mixed with 200 mg of ground sodium nitrate having a size of −200 U.S. mesh. To about 75 mg of the aluminum/sodium nitrate mixture is added 0.1 ml of a 20 percent solution of sodium hydroxide in water. The heat source generates heat rapidly and reaches a temperature of about 140° C. in less than 30 seconds. The heat source maintains a temperature above 100° C. but less than about 140° C. for about 7 minutes.

EXAMPLE 4

The following heat source is prepared:

About 50 mg of aluminum metal powder having a size of −200 U.S. mesh is mixed with 150 mg of granular sodium nitrate in a glass tube. To the resulting mixture is added 0.3 ml of a 5 percent solution of sodium hydroxide in water. The heat source generates heat rapidly and reaches a temperature of about 120° C. in about 14 seconds. The heat source maintains a temperature of about 100° C. for about 11 minutes. The heat source maintains a temperature of above about 80° C. for a total of about 12 minutes.

EXAMPLE 5

The following heat source is prepared:

About 5 g of granular calcium oxide is mixed with about 3.48 g of granular aluminum potassium sulfate dodecahydrate. About 0.5 g of the resulting mixture is mixed with 0.5 g calcium oxide and 0.5 g boric acid. The mixture is charged into a small test tube and remains at room temperature overnight. The following day, the test tube is heated with a flame of a cigarette lighter for about 2 seconds. The heat source generates heat rapidly to achieve a temperature of about 100° C., and maintains a temperature within the range of about 100° C. to about 135° C. for about 4 minutes.

EXAMPLE 6

The following heat source is prepared:

About 28 mg of aluminum metal powder having a size of −200 U.S. mesh is mixed with 86 mg of granular sodium nitrate and 86 mg potassium bicarbonate in a glass tube. To the resulting mixture is added 0.3 ml of a 5 percent solution of sodium hydroxide in water. The temperature of the reactant mixture rises to about 50° C. in less than 1 minute and remains at about 50° C. for about 15 minutes. Then the reactant mixture begins to generate heat such that the mixture exhibits a temperature in excess of 90° C. for a period from about 20 to about 30 minutes from the time that the sodium hydroxide solution is added to the aluminum, sodium nitrate and bicarbonate mixture. This example shows that the temperature of the initial temperature exhibited by the heat source can be controlled, and the components of the heat source can interact to generate heat at a later time.

EXAMPLE 7

The following heat source is prepared:

About 28 mg of aluminum metal powder having a size of −200 U.S. mesh is mixed with 86 mg of granular sodium nitrate and 86 mg of a granular barium hydroxide in a glass tube. To the reaction mixture is introduced a flame from a cigarette lighter for about 3 seconds. The heat source generates heat rapidly and reaches a temperature of about 320° C. in less than about 20 seconds. The heat source maintains a temperature in excess of about 100° C. for about 4 minutes.

What is claimed is:

1. A flavor delivery article comprising:
(a) a flavor; and
(b) a physically separate, non-combustion heat source for heating the flavor, and including
(i) a first chemical agent capable of interacting exothermically with a second chemical agent, and a third chemical agent capable of interacting exothermically with the first chemical agent, and
(ii) a dispersing agent for the first agent.

2. A flavor delivery article comprising:
(a) flavor; and
(b) a physically separate, non-combustion heat source for heating the flavor, and including
(i) a first chemical agent capable of interacting exothermically with a second chemical agent, and
(ii) a dispersing agent for the first agent, and
(iii) a phase change material.

3. The article of claim 2, wherein the heat source further includes a third chemical agent capable of interacting exothermically with the first chemical agent.

4. The article of claim 1 or 2, wherein the flavor is carried by a fibrous substrate.

5. The article of claim 3, wherein the flavor is carried by a fibrous substrate.

6. The article of claim 2, wherein the phase change material has a solid form prior to use of the article.

7. The article of claim 1 or 2, wherein the dispersing agent has a granular form.

8. The article of claim 1 or 2, wherein the heat source is capable of heating at least a portion of the flavor to a temperature in excess of about 70° C. within 20 seconds from the time that exothermic interaction of the chemical agents is initiated.

9. The article of claim 1 or 2, wherein the heat source is capable of heating at least a portion of the flavor to a temperature in excess of about 70° C. within 10 seconds from the time that exothermic interaction of the chemical agents is initiated.

10. The article of claim 1 or 2, wherein the heat source is such that the flavor is not heated to a temperature above about 350° C. during the life of the heat source.

11. The article of claim 1 or 2, wherein the heat source is such that the flavor is not heated to a temperature above about 180° C. during the life of the heat source.

12. A flavor delivery article comprising:
(a) flavor; and
(b) a physically separate, non-combustion heat source for heating the flavor, and including
(i) at least one chemical agent capable of interacting exothermically with water, and
(ii) a dispersing agent for the chemical agent.

13. The article of claim 12, wherein the heat source further includes a phase change material.

14. The article of claim 12 or 13, wherein the agent capable of interacting exothermically with water includes a metal oxide.

15. The article of claim 12, wherein the agent capable of interacting exothermically with water includes calcium oxide.

16. The article of claim 12, wherein the of interacting exothermically with water includes anhydrous magnesium sulfate.

17. The article of claim 12 or 13, wherein the heat source includes at least two agents capable of interacting exothermically with water.

18. The article of claim 13 wherein the phase change material includes a sugar.

19. The article of claim 13 wherein the phase change material includes a wax.

20. The article of claim 12, wherein the flavor is carried by a fibrous substrate.

21. The article of claim 12, wherein the dispersing agent has a granular form.

22. The article of claim 12 or 13, wherein the heat source is capable of heating a portion of the flavor to a temperature in excess of about 70° C. within 20 seconds from the time that exothermic interaction of the chemical agent with water is initiated.

23. The article of claim 12 or 13, wherein the heat source is such that the flavor is not heated to a temperature above about 350° C. during the life of the heat source.

24. The article of claim 12 or 13, wherein the heat source is such that the flavor is not heated to a temperature above about 180° C. during the life of the heat source.

25. A flavor delivery article comprising:
(a) flavor; and
(b) a physically separate, non-combustion heat source for heating the flavor, and including
(i) a first chemical agent capable of interacting exothermically with a second chemical agent, and
(ii) a phase change material.

26. The article of claim 25, wherein the heat source further includes a third chemical agent capable of interacting exothermically with the first chemical agent.

27. The article of claim 25, wherein the phase change material has a solid form prior to use of the article.

28. The article of claim 26, wherein the phase change material has a solid form prior to use of the article.

29. The article of claim 25, wherein the flavor is carried by a fibrous substrate.

30. The article of claim 25, wherein the heat source is capable of heating at least a portion of the flavor to a temperature in excess of about 70° C. within 20 seconds from the time that exothermic interaction of the chemical agents is initiated.

31. The article of claim 25, wherein the heat source is capable of heating at least a portion of the flavor to a temperature in excess of about 70° C. within 10 seconds from the time that exothermic interaction of the chemical agents is initiated.

32. The article of claim 25 or 26, wherein the heat source is such that the flavor is not heated to a temperature above about 350° C. during the life of the heat source.

33. The article of claim 25 or 26, wherein the heat source is such that the flavor is not heated to a temperature above about 180° C. during the life of the heat source.

34. A flavor delivery article comprising:
(a) flavor; and
(b) a physically separate, non-combustion heat source for heating the flavor, and including
(i) at least one chemical agent capable of interacting exothermically with water, and
(ii) a phase change material.

35. The article of claim 34, wherein the agent capable of interacting exothermically with water includes a metal oxide.

36. The article of claim 34, wherein the agent capable of interacting exothermically with water includes anhydrous magnesium sulfate.

37. The article of claim 34, wherein the heat source includes at least two agents capable of interacting exothermically with water.

38. The article of claim 34, wherein the flavor is carried by a fibrous substrate.

39. The article of claim 34, wherein the heat source is capable of heating a portion of the flavor to a temperature in excess of about 70° C. within 20 seconds from the time that exothermic interaction of the chemical agent with water is initiated.

40. The article of claim 34, wherein the heat source is such that the flavor is not heated to a temperature above about 350° C. during the life of the heat source.

41. The article of claim 34, wherein the heat source is such that the flavor is not heated to a temperature above about 180° C. during the life of the heat source.

42. A flavor delivery article comprising:
(a) flavor; and
(b) a physically separate, non-combustion heat source for heating the flavor, and including:
(i) a first chemical agent,
(ii) a second chemical agent capable of interacting exothermically with the first chemical agent,
(iii) a third chemical agent capable of interacting exothermically with the first chemical agent;
the heat source being capable of heating at least a portion of the flavor to at least about 70° C. within 20 seconds of initiation and to a maximum temperature of less than about 200° C.

43. The article of claim 42, wherein the heat source is capable of heating at least a portion of the flavor to at least about 70° C. within 10 seconds of initiation and to a maximum temperature of less than about 180° C.

44. The article of claim 42 or 43, wherein the heat source further includes a dispersing agent.

45. A flavor delivery article comprising:
(a) flavor; and
(b) a physically separate, non-combustion heat source for heating the flavor, the heat source including at least one chemical agent capable of interacting exothermically with water; the heat source being capable of heating at least a portion of the flavor to at least about 70° C. within 20 seconds of initiation and to a maximum temperature of less than about 200° C.

46. The article of claim 45, wherein the heat source is capable of heating at least a portion of the flavor to at least about 70° C. within 10 seconds of initiation and to a maximum temperature of less than about 180° C.

47. The article of claim 45 or 48, wherein the heat source further includes a dispersing agent.

48. A flavor delivery article comprising:
(a) flavor; and
(b) a physically separate, non-combustion heat source for heating the flavor, and including:
(i) first, second and third chemical agents capable of undergoing an exothermic chemical reaction with one another,
(ii) a fourth agent capable of reacting with a reaction product of the exothermic chemical reaction to regenerate the second and third chemical agents for reaction with remaining first chemical agent.

49. The article of claim 48, wherein the first agent is magnesium and/or aluminum, the second agent is water, the third agent is sodium hydroxide, and the fourth agent is sodium nitrite and/or sodium nitrate.

50. The article of claim 49, wherein the amount of first agent and fourth agent per article ranges from about 50 mg to about 300 mg.

51. A flavor delivery article comprising:
(a) flavor; and
(b) a physically separate, non-combustion heat source for heating the flavor, and including
(i) a first chemical agent capable of interacting exothermically with a second chemical agent, and
(ii) a normally solid dispersing agent for the first agent.

52. The article of claim 51, wherein the dispersing agent has a granular form.

53. The article of claim 51, wherein the heat source is capable of heating at least a portion of the flavor to a temperature in excess of about 70° C. within 20 seconds from the time that exothermic interaction of the chemical agents is initiated.

54. The article of claim 51, wherein the heat source is capable of heating at least a portion of the flavor to a temperature in excess of about 70° C. within 10 seconds from the time that exothermic interaction of the chemical agents is initiated.

55. The article of claim 51, wherein the heat source is such that the flavor is not heated to a temperature above about 350° C. during the life of the heat source.

56. The article of claim 51, wherein the heat source is such that the flavor is not heated to a temperature above about 180° C. during the life of the heat source.

57. The article of claim 44, wherein the dispersing agent has a normally solid form.

58. The article of claim 47, wherein the dispersing agent has a normally solid form.

59. The article of claim 12, wherein the dispersing agent has a normally solid form.

60. The article of claim 1, 2 or 3, including a mouthend piece for delivering flavor volatilized by the heat source to the mouth of the user of the article.

61. The article of claim 12 or 13, including a mouthend piece for delivering flavor volatilized by the heat source to the mouth of the user of the article.

62. The article of claim 34 including a mouthend piece for delivering flavor volatilized by the heat source to the mouth of the user of the article.

63. The article of claim 42 or 43 including a mouthend piece for delivering flavor volatilized by the heat source to the mouth of the user of the article.

64. The article of claim 45 or 46, including a mouthend piece for delivering flavor volatilized by the heat source to the mouth of the user of the article.

65. The article of claim 48 or 49, including a mouthend piece for delivering flavor volatilized by the heat source to the mouth of the user of the article.

66. The article of claim 51, including a mouthend piece for delivering flavor volatilized by the heat source to the mouth of the user of the article.

67. The article of claim 12, wherein the chemical agent(s) and dispersing agent have solid forms.

68. The article of claim 13, wherein the chemical agent(s), dispersing agent and phase change material have solid forms.

69. The article of claim 34 wherein the chemical agent(s) and phase change material have solid forms.

* * * * *